US005088014A

United States Patent [19]

Boughey

[11] Patent Number: 5,088,014

[45] Date of Patent: Feb. 11, 1992

[54] TOOL CADDY WITH ADJUSTABLE LIGHT BOOM

[76] Inventor: Kenneth Boughey, 314 N. First St., Laurens, Iowa 50554

[21] Appl. No.: 640,894

[22] Filed: Jan. 14, 1991

[51] Int. Cl.[5] ..... F21V 33/00

[52] U.S. Cl. ..... 362/132; 362/269; 362/285; 362/418

[58] Field of Search ..... 362/61, 80, 66, 269, 362/285, 413, 418, 419, 422, 427, 132

[56] References Cited

U.S. PATENT DOCUMENTS 2,896,066 7/1959 Quetin ..... 362/335
3,601,598 8/1971 Horn ..... 362/418
4,232,357 11/1980 Dietz ..... 362/61

FOREIGN PATENT DOCUMENTS 740790 11/1932 France ..... 362/61

*Primary Examiner*—Ira S. Lazarus
*Assistant Examiner*—Sue Hagarman
*Attorney, Agent, or Firm*—G. Brian Pingel

[57] ABSTRACT

An improved tool caddy with adjustable light boom that is readily movable on a supporting surface and includes a central support member having trays for storing a plurality of tools, a plurality of caster wheels attached to one of the trays, an extension member associated with the support member in a telescoping relationship, a light boom pivotally connected to one end of the extension member, and an adjustable strut for changing and semi-permanently fixing the position of the light boom with respect to the extension member.

8 Claims, 5 Drawing Sheets 76
72
78
70
106
74
14
68
68
14
10
86
64
88
66
84
50
65
48
46
54
58
100
20
21
38
24
18
19
12
38
60
26
52
28
30
44
44
44
42
42
32
34
56
16
42
66
64
46
20
58
24
12
18
44
42
32
44
26
30
42
16
28
42
42
3
3

TOOL CADDY WITH ADJUSTABLE LIGHT BOOM

BACKGROUND OF THE INVENTION

1. Field of the Invention

The present invention relates in general to portable tool caddies and more particularly to such caddies that have a light source associated with them.

2. Description of the Prior Art

A variety of tool caddy constructions are known in the prior art, as well as carts for other types of articles such as cleaning supplies, etc. Furthermore it is not unusual for such caddies or carts to include caster wheels for convenience of portability. Previously issued patents for various types of caddy or cart constructions are disclosed in U.S. Pat. Nos. 2,819,485; 2,596,749; 3,132,641; and 3,573,879.

It is also known in the prior art to have a portable cart that, among other things, is designed for carrying tools and further includes a source of light mounted on a telescoping boom attached to the cart as disclosed in U.S. Pat. No. 4,457,527.

The present invention differs from the above mentioned prior art constructions in that it includes a pivoting extension boom that permits the three dimensional placement of a light source, and a support base designed to not only provide for the storage of numerous tools, but also is specifically designed to reduce the risk that the caddy may tip as the boom is positioned.

SUMMARY OF THE INVENTION

The present invention provides an improved tool caddy that is readily movable on a supporting surface and comprises a vertically aligned central support member that is associated in a telescoping relationship with an extension member connected at one end to a pivotally adjustable light boom for carrying a light fixture. Means are attached to the central support member for storing a plurality of tools on the caddy, and a plurality of caster wheels are connected to the storing means to provide portability of the caddy.

Means are provided for semi-permanently fixing the telescoping relationship of the extension member with respect to the support member. Furthermore, means are also provided for adjustably changing and semi-permanently fixing the position of the light boom with respect to the extension member.

DETAILED DESCRIPTION OF THE PREFERRED EMBODIMENT

Figures 1, 3:
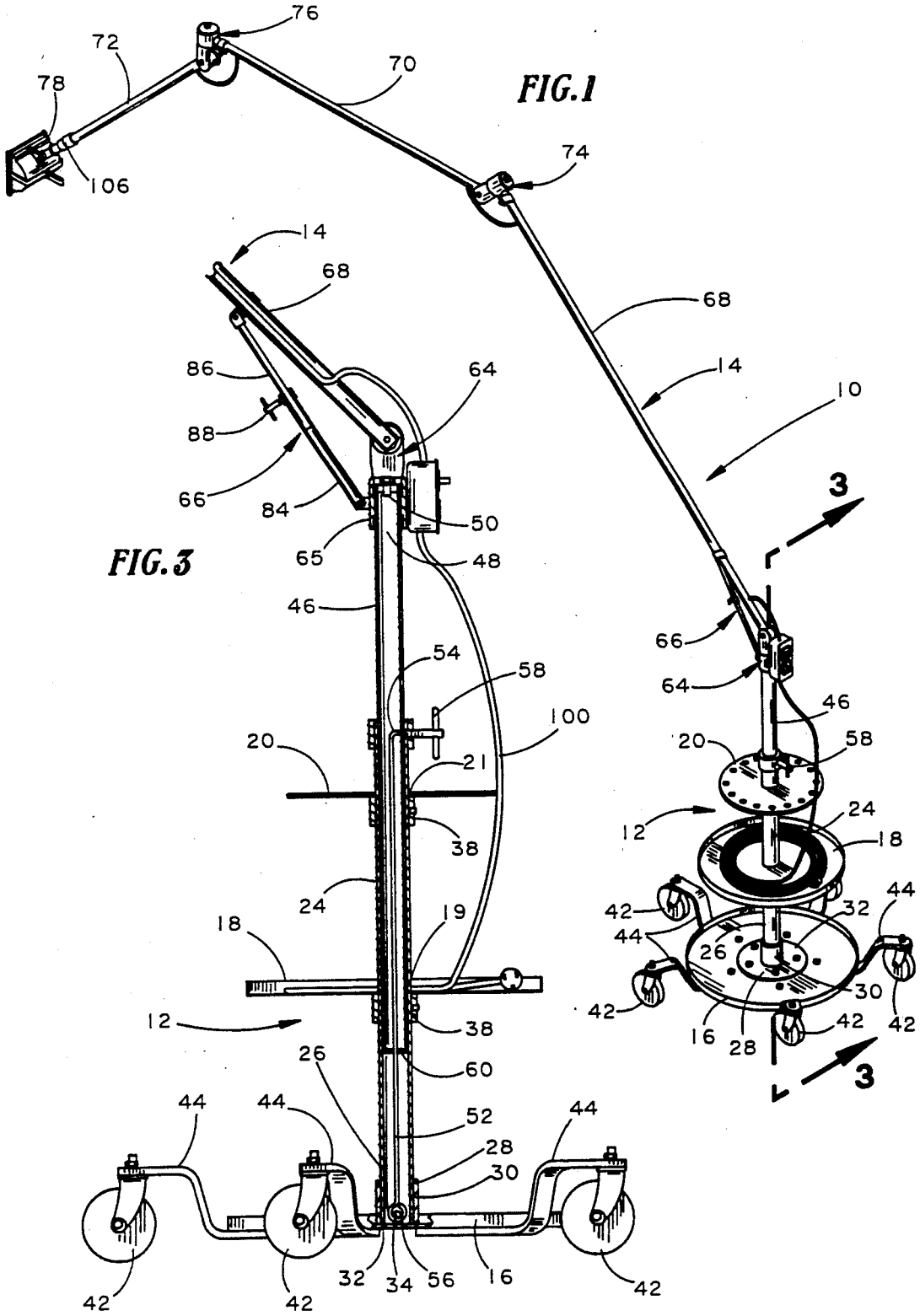
FIG. 1 is a reduced perspective side view of a preferred embodiment of the tool caddy of the present invention that includes a support base and an adjustable light boom.
FIG. 3 is a cross-sectional view taken along line 3-3 in FIG. 1.

With reference to the drawings, the tool caddy of this invention is indicated generally at 10 in FIG. 1, and includes a readily portable support base 12 and an adjustable light boom 14.

Figure 2:
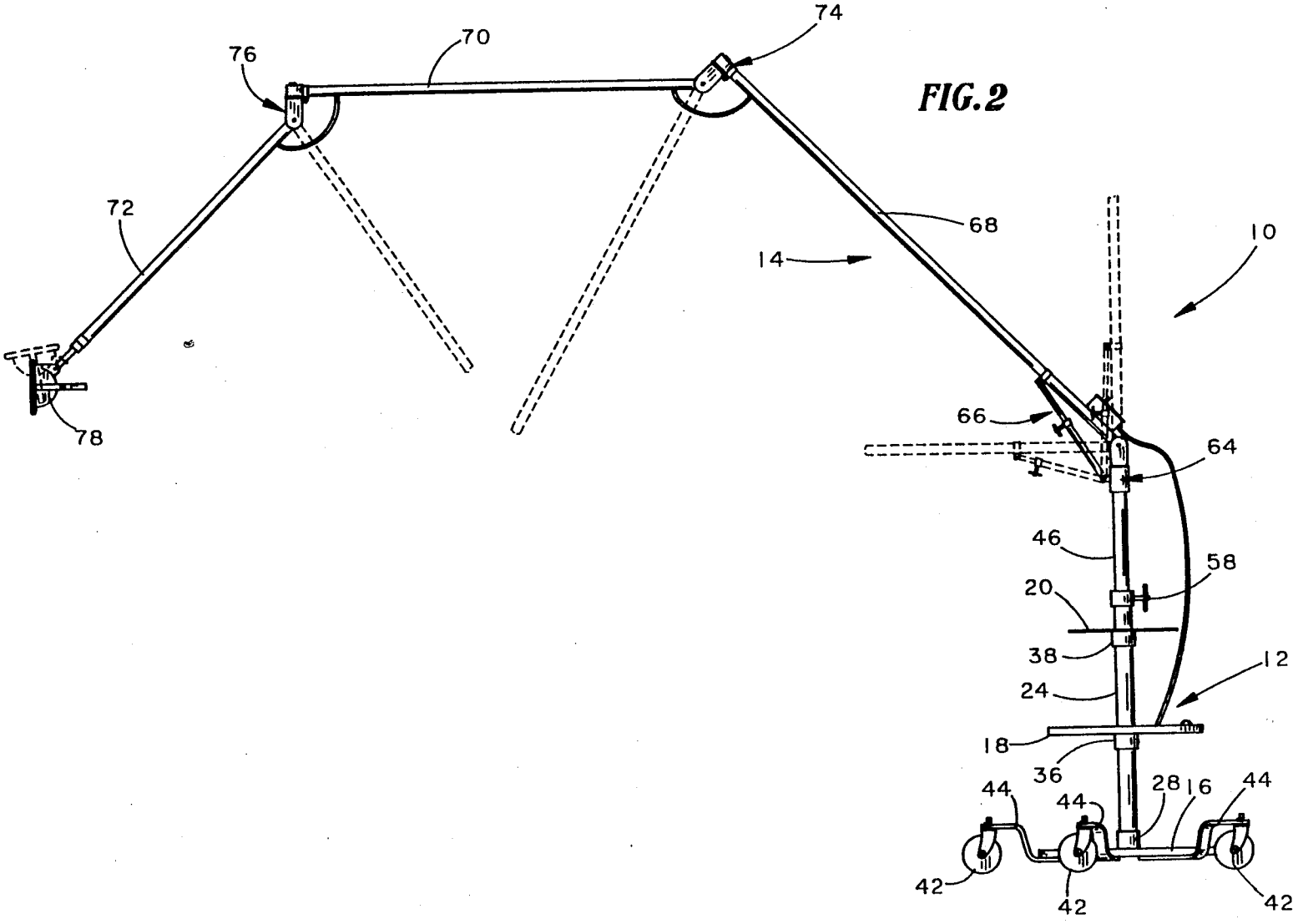
FIG. 2 is a side view of the embodiment of FIG. 1 with dotted lines shown for representing the various adjustable positions of the light boom.
Figure 4:
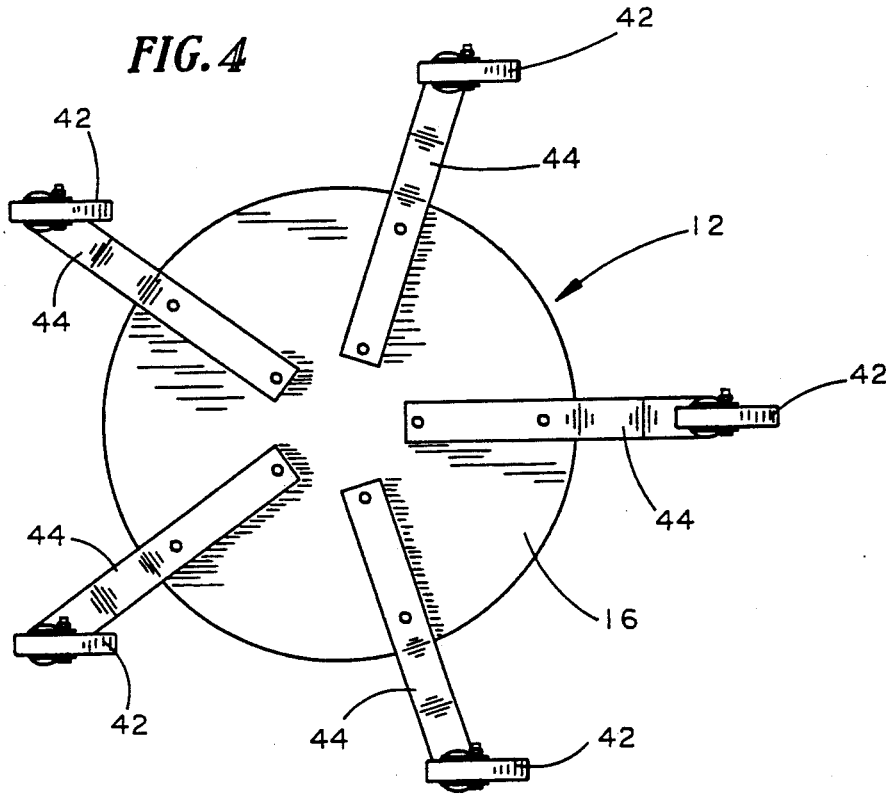
FIG. 4 is a bottom view of the support base of the embodiment of FIG. 1.

Referring to FIGS. 1–3, the support base 12 has a circular bottom tray 16, a circular upper tray 18, and a circular tool receptacle 20 located above the upper tray 18. A tube type central support member 24 is vertically aligned so as to be oriented perpendicular to the bottom tray 16, the upper tray 18, and the tool receptacle 20. The lower end 26 of the support member 24 is affixed as by bolts to the midpoint of the bottom tray 16 through the use of a support collar plate 28. The collar plate 28 is comprised of a socket portion 30 to a round plate portion 32. The plate is attached to the bottom tray 16 so that the socket portion 30 is located directly in the middle thereof.

Located in the support member lower end 26 are two oppositely arranged bolt holes (not shown). In a similar fashion, two oppositely arranged holes (not shown) are located in the socket portion 30 of the collar plate 28. The lower end 26 of the support member 24 is insertable into the socket portion 30 so that both sets of holes in the support member 24 and socket portion 30 are aligned, thereby allowing the passage of a common bolt 34 to secure the support member 24 to the collar plate 28.

In the middle of both the upper tray 18 and the tool receptacle 20 are small round cutouts 19 and 21 respectively, whose diameters are slightly larger than the outside cross-sectional diameter of the support member 24. These cutouts 19 and 21 allow both the upper tray 18 and the tool receptacle 20 to be rotatably received onto the support member 24. The cutouts 19 and 21 preferably have sidewalls that contain middle recessed portions designed to retain bushings made of a preferred composite type material. Thus, when the upper tray 18 and the tool receptacle 20 are located on the support member, the bushin9s, being the only part in contact with the support member, provide a reduced friction therebetween.

The vertical positioning of both the upper tray 18 and tool receptacle 20 is provided through the use of lock collars 36 and 38 respectively (FIG. 3). The collars 36 and 38 are each slid one at a time onto the support member 24 to a desired location and then secured. The upper tray 18 or tool receptacle 20 can then be slid over and down the support member 24 until contact is reached with its respective lock collar. Thus, the location of both the upper tray 18 and tool receptacle 20 can be adjusted by repositioning their respective collars 36 or 38 on the support member 24.

The mobility of the tool caddy 10 is provided by a plurality of caster wheels 42 attached to the bottom tray 16 through the use of S-shaped arms 44 as indicated by FIGS. 1–4. The caster wheels 42 are pivotally connected to the outer ends of the S-shaped arms 44 with the outer ends, being elevated above the inner ends which are secured to the bottom tray 16. This configuration enables the support base 12 to have a low center of gravity to provide the caddy 10 with an anti-tipping stability.

A tube type extension member 46 is telescopically associated with the central support member 24. The upper end 48 of the extension member 46 is capped and a bolt 50 extends vertically upward from the top of the capped end 48 for a purpose to be discussed later. Slidably located within the hollow center of the extension member 46 and extending from the bottom end thereof is a long, narrow retainer rod 52 that has a hooked portion 54 at its upper end and a horizontally aligned tube 56 attached to its bottom end. The length of the tube 56 is slightly smaller than the inner cross-sectional diameter of the support member 24 and the bolt 34 used to secure the support member 24 to the collar plate 28 is also passed through the tube 56 and thereby affixes the bottom of the retainer rod 52 within the support member 24.

When the extension member 46 is in a retracted position, its entire body, except for the uppermost portion, is enclosed within the support member 24, with the bottom of the extension member 46 resting upon the retainer rod tube 56. In this position, the retainer rod 52 is located within the extension member 46. A lock screw 58 is located in a threaded hole in the upper end of the support member 24 and may be tightened against the side of the extension member 46 and thus provide a means for semi-permanently retaining the extension member 46 in a desired position with respect to the support member 24.

To prevent the extension member 46 from being pulled completely out of the support member 24 a metal washer 60 (shown only in FIG. 3) is attached to the bottom of the extension member 46. Because the hooked portion 54 of the rod 52 is larger than the diameter of the inner hole of the washer 60, the hooked portion 54 is retained within the extension member 46. Thus, the extension member 46 cannot be pulled out of the support member 24 beyond the point where the hooked end 54 catches the washer 60.

The light boom 14 of the preferred embodiment, as seen in FIGS. 1 and 2, includes a yoke cap 64, an adjustable strut 66, a main arm 68, a middle arm 70, an outer arm 72, two adjustable joints 74 and 76, and a light fixture 78. The yoke cap 64 provides a means for pivotally attaching the light boom to the extension member 46 of the tool cart or, as will be described later, to a wall mount. A bottom portion 65 of the cap 64 is open ended and has an inner diameter that allows for a snug fit over the top portion of the extension member 46. Preferably, there are two recessed sections and bushings located in the inner sidewall of the cap bottom portion 65 to provide for smooth rotational movement between the cap 64 and extension member 46. A hole in the top of the cap bottom portion 65 allows the bolt 50 of the extension member 46 to pass through and thus permits the yoke cap 64 to be secured to the extension member with a common hex-nut.

Figure 8:
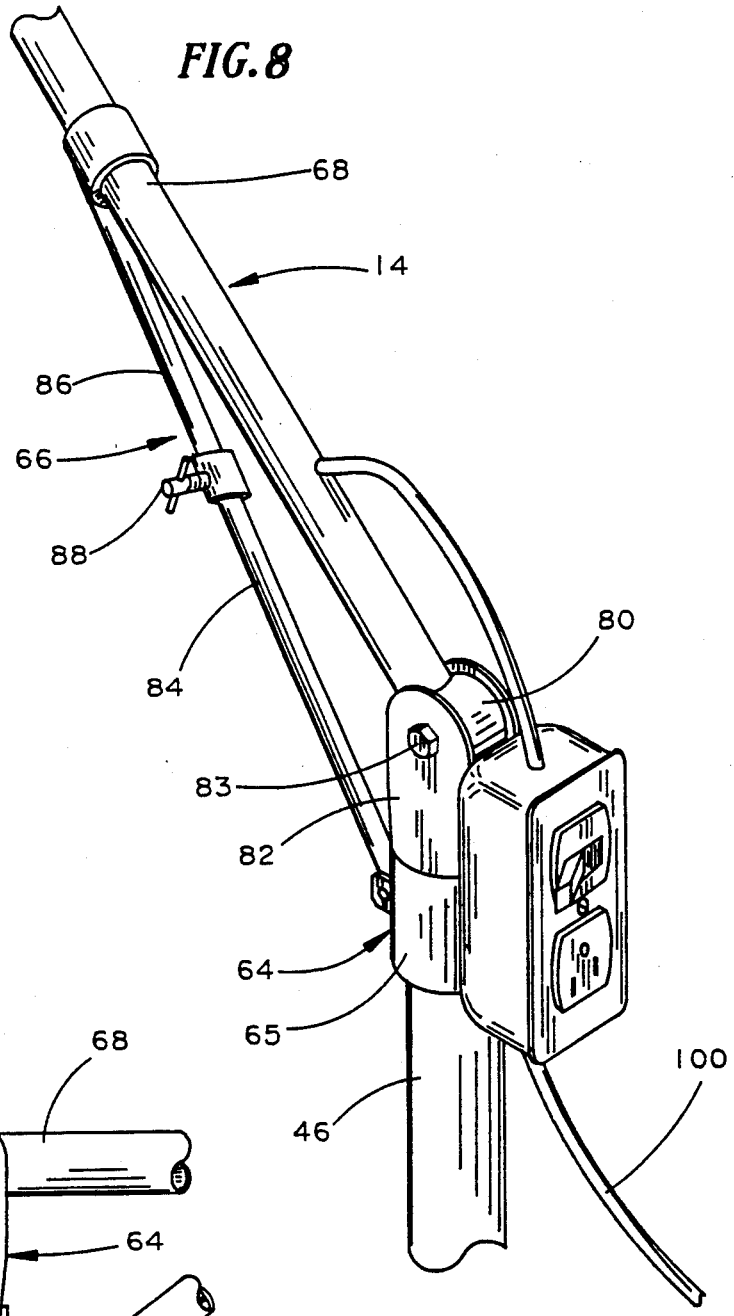
FIG. 8 is a fragmentary view of a top portion of the support base and the lower end of the adjustable boom of FIG. 1.

The main, middle, and outer arms 68, 70 and 72 respectively are all generally made of narrow tubes with the main arm 68 being longer than the other arms 70 and 72. Located at the inner end of the main arm 68 is a cylindrically shaped, pivot portion 80 (FIG. 8). The pivot portion 80 fits in between arms 82 of the yoke cap 64 and a bolt 83 is inserted and passed through the yoke cap arms 82 and the pivot portion 80 to thereby pivotally secure such parts together.

The adjustable strut 66 has an outer sleeve 84 pivotally secured at its lower end to the upper portion of the extension member 46 and an inner member 86 pivotally secured at its upper end to the lower end of the main arm 68 to provide a means for semi-permanently fixing the position of the main arm 68 with respect to the extension member 46. Because the inner member 86 is slidably located within the outer sleeve 84, the main arm can be rotated to a position ranging from approximately 45° to 180° with respect to the member 46, and by tightening a strut lock 88 on the strut 66, a desired position therefor can be temporarily secured.

Figure 5:
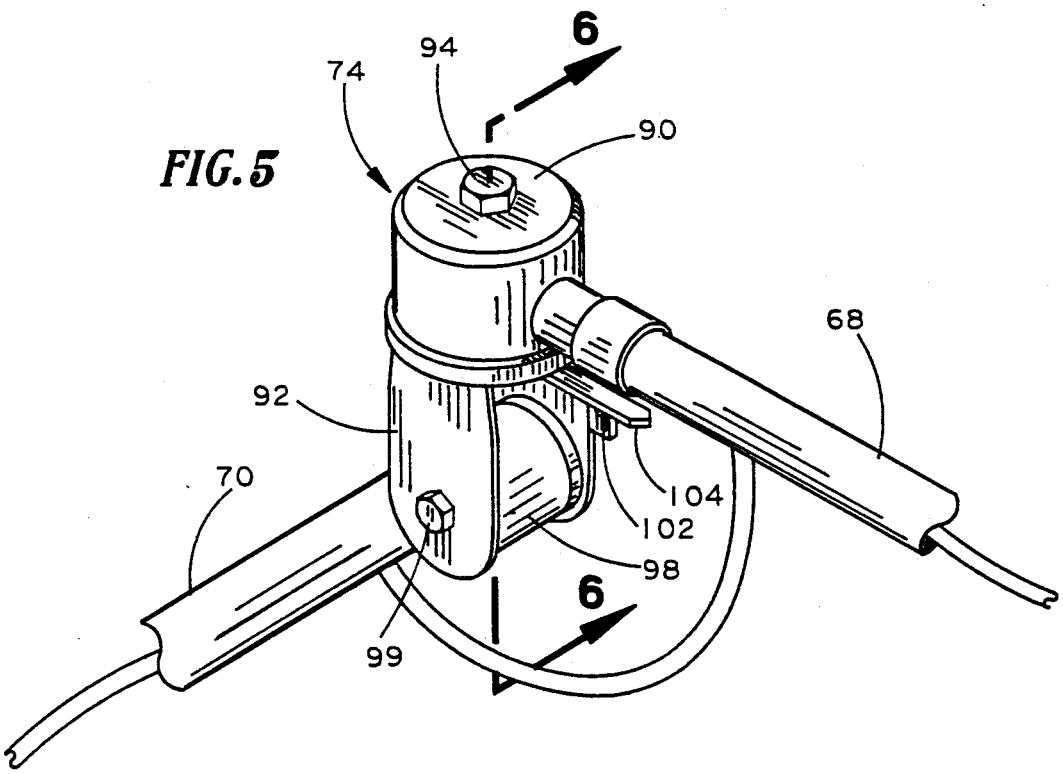
FIG. 5 is a perspective view showing one of two joints included in the adjustable boom of FIG. 1.
Figure 6:
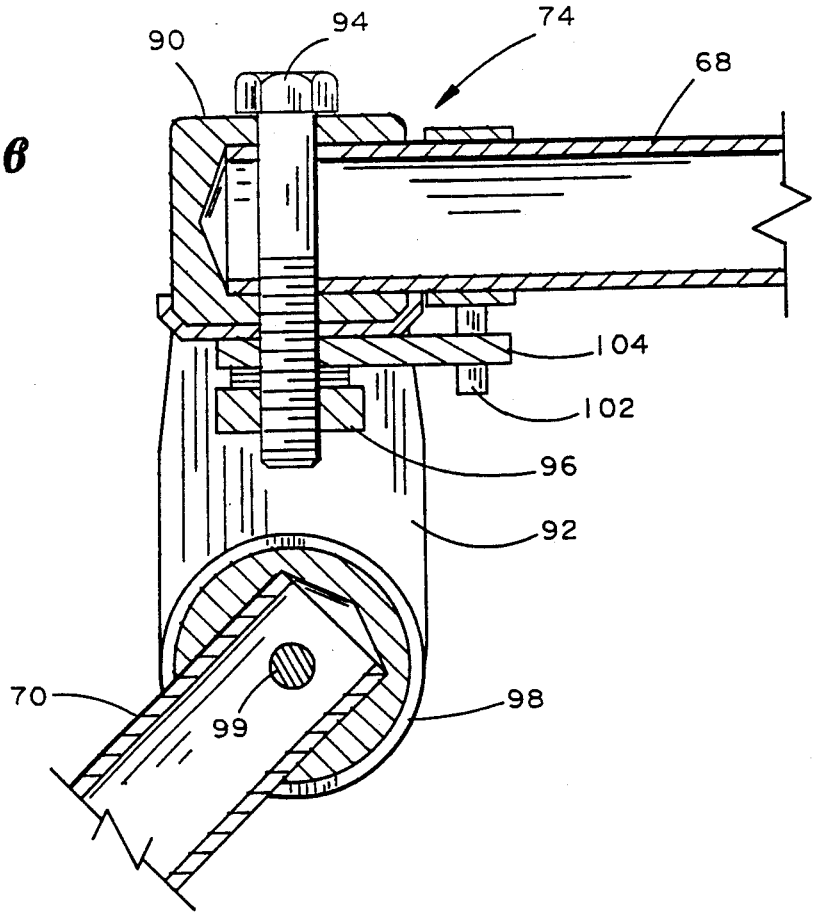
FIG. 6 is a cross-sectional view taken along the line 6-6 of FIG. 5.

The first pivot joint 74, as indicated in FIGS. 5 and 6, is located at the outer end of the main arm 68 and permits the middle arm 70 to be pivoted and rotated with respect to the main arm 68. The adjustable joint 74 is comprised of a cylindrically shaped pivot cap 90 attached to the top of a downward facing yoke 92 by a bolt 94 and lock nut 96. The lock nut 96 can be positioned on the bolt 94 to establish a desired force that is required to rotate the pivot cap 90 with respect to the yoke 92.

Just as with the inner end of the main arm 68, the inner end of the middle arm 70 has a cylindrically shaped pivot portion 98 pivotally attached by another bolt and lock nut assembly 99 between arm of the yoke 92, thereby comprising another pivot assembly for the boom 14. The bolt and lock nut assembly 99 is used to provide an adjustable pressure to secure a desired relative position between the main arm 68 and middle arm 70.

Thus, the joint 74 permits a two dimensional freedom of movement of the middle arm 70 with respect to the main arm 68. However, to prevent tangling of an electrical cable 100 that is secured to the boom 14, an abutment member 102 is secured to the main arm 68, and a cam 104 is fastened to the yoke 92 so that the yoke cannot be rotated over 360° with respect to the pivot cap 90. The other adjustable joint 76 exists between the middle arm 70 and outer arm and is of a similar construction to the joint 74.

Figure 7:
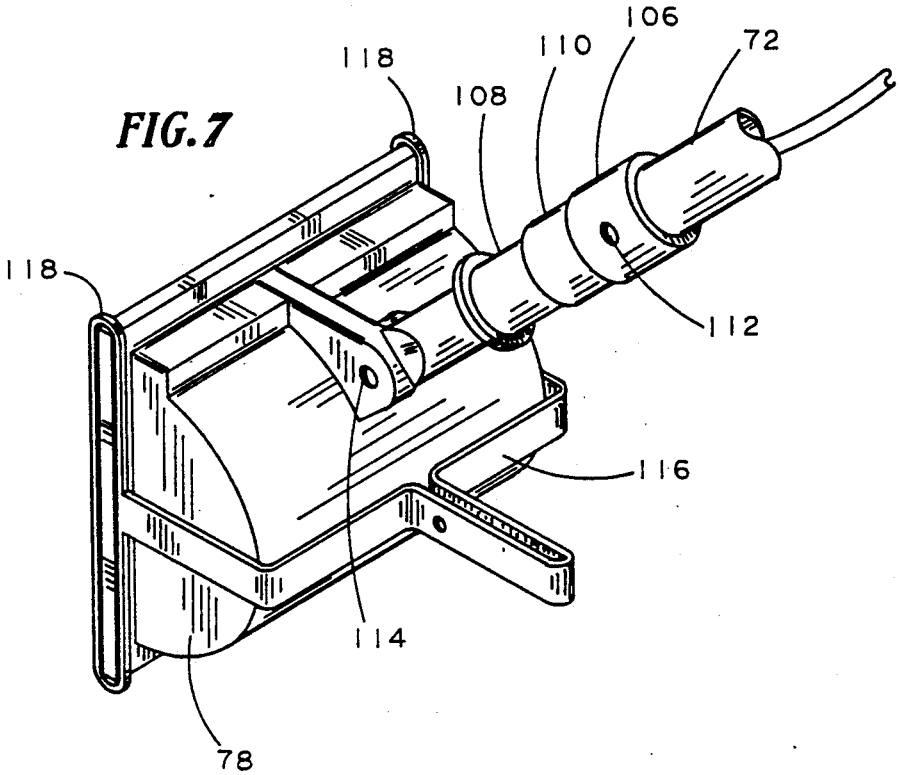
FIG. 7 is a perspective view of a light fixture included on the outer end of the adjustable boom shown in FIG. 1.

Referring now to FIG. 7, an open, enlarged outer end 106 of the outer arm 72 is attached to a neck portion 108 of the light fixture 78 by a collar 110 screwed onto the neck portion 108. The end 106 is enlarged to receive the collar 110, which is secured therein by a locking screw 112. As shown best in FIG. 7 the light fixture neck 108 is attached to a housing for the fixture 78 by a pivot connection 114. Preferably, the light fixture 78 is parabolic in shape with a flat glass plate protecting the light element contained within. A handle 116 extends across the bakc of the fixture 78 and has two long, narrow loops 118 that secure the handle 116 to the front of the fixture.

Figure 10:
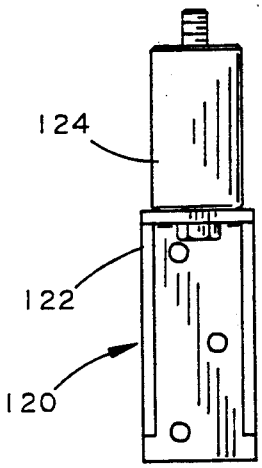
FIG. 10 is a front view of the support bracket of FIG. 9.
Figure 9:
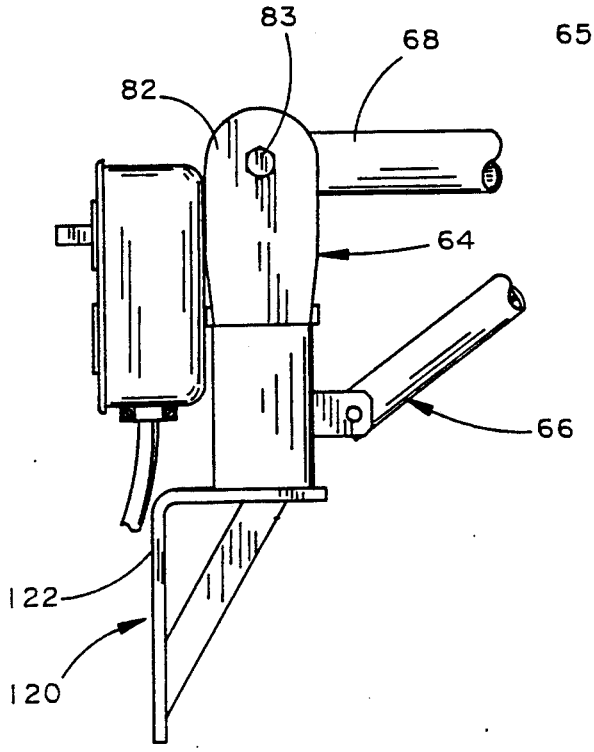
FIG. 9 is a side view of a preferred embodiment of a wall support bracket for and a fragmentary portion of the adjustable boom shown in FIG. 1.

Referring now to FIGS. 9 and 10, it is not essential that the light boom 14 be utilized with the support base 12. Instead, a wall mount 120 may serve to support the boom 14. The mount 120 includes a base portion 122 that can be secured to a wall and an attached tubular upper portion 124 that is similar to the upper end 48 of the extension member 46. Thus, the portion 124 is adapted to be received within the yoke cap 64 for securement of the boom 14 to the wall mount 120.

I claim:

1. An improved tool caddy that is readily movable on a supporting surface, said tool caddy comprising:

(a) a vertically aligned central support member;
(b) means attached to said support member for storing a plurality of tools on said caddy;
(c) a plurality of caster wheels connected to said storing means;
(d) an extension member associated with the upper end of said support member in a telescoping relationship and having an upper end and a lower end;
(e) means for semi-permanently fixing the telescoping relationship of said extension member with respect to said support member;
(f) a light boom pivotally connected at one end to the upper end of said extension member;
(g) a light fixture secured to the other end of said boom;
(h) said light boom having:
1. a main inner arm that is connected at one end to said extension member; and
2. an outer section that is pivotally connected to the other end of said main arm to thereby provide a means for two dimensional freedom of movement of said light fixture; and
(i) means for adjustably changing and semi-permanently fixing the position of said light boom with respect to said extension member.

2. An improved tool caddy as recited in claim 1, further comprising a tool receptacle that is attached to said support member and in which various tools may be hung.

3. An improved tool caddy as recited in claim 1 wherein said changing means comprises an adjustable strut located between said light boom and said extension member and containing an outer sleeve and an inner arm telescopically received therein providing a means for said light boom to be temporarily secured in a rigid position ranging from approximately 45° to 180° with respect to said extension member.

4. An improved tool caddy as recited in claim 1 wherein said storing means includes a tray located at the lower end of said support member.

5. An improved tool caddy as recited in claim 4, wherein said caster wheels are connected to said bottom tray through the use of S-shaped arms each having an outer end elevated above said bottom tray and attached to said wheels to provide said tool caddy with a low center of gravity.

6. An improved tool caddy as recited in claim 1, wherein said light boom comprises:
(a) a main inner arm pivotally connected at one end to said extension member;
(b) a middle arm pivotally connected at one end to the opposite end of said inner arm;
(c) an outer arm pivotally connected at one end to the opposite end of said middle arm; and
(d) said light fixture pivotally connected to the opposite
end of said outer arm.

7. An improved tool caddy as recited in claim 1, further comprising a retainer rod that is slidably located inside said extension member and is secured at one end to the bottom of said support member and has an opposite end to catch and retain said extension member in said support member.

8. An improved light boom that can be pivotally secured at one end to a stationary mounting means, said light boom comprising:
(a) a main inner arm pivotally connected at one end to said mounting means;
(b) at least one outer arm pivotally connected at one end to the opposite end of said main inner arm;
(c) said pivotal connection of said inner and outer arm allowing for a two dimensional freedom of movement between said arms;
(d) means for adjustably changing and semi-permanently fixing the position of said inner arm with respect to said mounting means, said adjustably changing means including an adjustable strut located between said inner arm and said mounting means and containing an outer sleeve and an inner arm telescopingly received therein providing a means for said inner arm to be temporarily secured in a rigid position ranging from approximately 45° and 180° with respect to said mounting means; and
(e) a light fixture pivotally secured to the opposite end of said outer arm.

* * * * *